US006483403B2

(12) United States Patent
Hirabayashi et al.

(10) Patent No.: US 6,483,403 B2
(45) **Date of Patent: *Nov. 19, 2002**

(54) FILTER ELEMENT AND FABRICATION THEREOF

(75) Inventors: Takayuki Hirabayashi, Tokyo (JP); Akihiko Okubora, Kanagawa (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/374,111

(22) Filed: Aug. 16, 1999

(65) Prior Publication Data

US 2002/0005769 A1 Jan. 17, 2002

(30) Foreign Application Priority Data

Aug. 24, 1998 (JP) ..... 10-237130

(51) Int. Cl.[7] ..... H01P 1/203; H01P 3/08; H01P 11/00

(52) U.S. Cl. ..... 333/204; 333/246; 333/238

(58) Field of Search ..... 333/204, 246, 333/238

(56) References Cited

U.S. PATENT DOCUMENTS

| | | | | |
|---|---|---|---|---|
| 5,153,542 A | * | 10/1992 | Tai et al. | 333/204 |
| 5,158,820 A | * | 10/1992 | Scammell | 333/238 X |
| 5,227,742 A | * | 7/1993 | Suzuki | 333/1 |
| 5,293,140 A | * | 3/1994 | Higgins | 333/204 |
| 5,319,330 A | * | 6/1994 | Leeb | 333/238 |
| 5,532,643 A | * | 7/1996 | Kuffner et al. | 333/246 |
| 6,278,341 B1 | * | 8/2001 | Lindqvist | 333/126 |

FOREIGN PATENT DOCUMENTS

DE 2444228 * 3/1976

* cited by examiner

*Primary Examiner*—Robert Pascal
*Assistant Examiner*—Stephen E. Jones
(74) *Attorney, Agent, or Firm*—Sonnenschein, Nath & Rosenthal

(57) ABSTRACT

The invention includes a filter element comprising a dielectric substrate and a strip conductive pattern formed on the dielectric substrate. The dielectric substrate has cavities with apertures on the surface of the dielectric substrate. The strip conductive pattern is formed over the apertures of the cavities to serve as inductance. The strip conductive pattern has an approximately uniform line width that effectively improves the production yield and reliability of the filter element.

25 Claims, 6 Drawing Sheets freq 20.0 GHz [1]
freq 20.0 GHz [2]

[1] PATTERN FORMED ON SPACE (ε=1)

1.0mm WIDTH 0.7mm LENGTH

[2] PATTERN FORMED ON DIELECTRIC (ε=5.7, THICKNESS = 900μm)

0.1mm WIDTH 0.3mm LENGTH

FILTER ELEMENT AND FABRICATION THEREOF

RELATED APPLICATION DATA

The present application claims priority to Japanese Application No. P10-237130 filed Aug. 24, 1998, which application is incorporated herein by reference to the extent permitted by law.

BACKGROUND OF THE INVENTION

1. Field of the Invention

The present invention relates to a filter element, and more particularly relates to a distributed constant filter.

2. Description of Related Art

Cellular telephones, radio-Local Area Networks (radio-LAN), and other high frequency communication devices that use a microwave band or milliwave band carrier typically have filter elements, such as low pass filter (LPF) and band pass filter (BPF). The filter elements may be designed using a distributed constant filter formed with a conventional microstrip transmission line. Unlike filter elements that have a composite component consisting of an inductor (L) and a capacitor (C) that are combined to form an L-C circuit having a concentrated or lumped constant L-C parameter, a conventional microstrip transmission line has serially distributed L and C parts formed on a substrate as shown in FIGS. 1 and 2.

FIG. 1 is a plan view illustrating the structure of a conventional filter element 10 formed with a microstrip transmission line. The conventional filter element 10 includes a dielectric (or insulating) substrate 12 such as a ceramic substrate or a printed substrate (e.g., a dielectric, such as silicon dioxide or silicon nitride, is deposited on a substrate and then masked using known fabrication techniques to form a printed dielectric pattern on the substrate). The conventional filter element 10 also includes a strip conductor pattern 14 formed on the dielectric substrate 12, and I/O electrodes 16 and 18 that are electrically connected to the strip conductor pattern 14. The strip conductor pattern 14 includes a first group of segments 20, 22, 24, and 26 that function as inductors and a second group of segments 28, 30, and 32 that function as capacitors. Each inductor segment 20, 22, 24 and 26 has a width (e.g., width 23 of inductor segment 20 as shown in FIG. 1) of about 0.1 millimeters (mm) and a length (e.g., length 21 of inductor segment 20) of about 0.3 mm. Each capacitor segment 28, 30, and 32 has a width (e.g., width 29 of capacitor segment 28 as shown in FIG. 1)of about 5 mm and a length (e.g., length 27 of capacitor segment 28)of about 3 mm. The conventional filter element 10 shown in FIG. 1 is a microstrip line LPF that has an impedance which is varied alternately as a result of forming the strip conductor pattern 14 on the dielectric substrate 12. By forming the strip conductor pattern 14 to have inductor segments and capacitor segments that are optimally sized, a signal in a bandwidth higher than a desired frequency can be attenuated.

An equivalent electrical circuit representation 50 of the conventional filter element 10 is shown in FIG. 2. The inductor segments 20, 22, 24, and 26 correspond to the inductors 52, 54, 56, and 58, respectively. The capacitor segments 28, 30, and 32 correspond to the capacitors 60, 62, and 64, respectively. Because the inductor segments and the capacitor segments in the conventional filter element 10 have a flat structure, the filter element 10 can be formed simultaneously in a process for forming a wiring pattern on a mounting substrate using known printing or lithography techniques.

However, in forming the conventional filter element 10 as described above, a problem arises where the inductance effect (e.g., ability to oppose any change to a electrical current flowing through the filter element) of the equivalent electrical circuit 50 shown in FIG. 9 is reduced due to a parasitic capacitance of the portion of the dielectric between the substrate 12 and the strip conductor pattern 14 that occurs when a signal in the frequency range of microwave and milliwave is transmitted through the filter element 10. Parasitic capacitance, for example, may be the capacitance or collection of charge between a conduction layer, such as the strip conductor pattern 14 and a base, such as the substrate 12. Parasitic capacitance, which degrades the performance of a circuit on a substrate or chip, is not intentionally designed into the chip or circuit but is rather a consequence of the layout of the circuit on the chip. This problem of parasitic capacitance is particularly prevalent when the transmitted signal through the conventional filter element 10 is in the frequency range exceeding 5 GHz.

To prevent the reduction in the inductance effect of the equivalent electrical circuit 50 and to obtain the desired filter performance, the inductance in the conventional filter element 10 is increased by thinning the width of the inductor segments 20, 22, 24 and 26 in the strip conductor pattern 14 shown in FIG. 1. Further, to reduce the passband loss of the filter element 10, the length of each inductor segment 20, 22, 24, and 26 is reduced substantially. Passband loss, defined in decibels (dB), describes the absolute loss across a band of frequencies the conventional filter element 10 is supposed to pass.

By substantially reducing the width and the length of the inductor segments 20, 22, 24, and 26 within the strip conductor pattern 14, the resulting conventional filter element 10 has the following other problems:

1) The inductor segments 20, 22, 24, and 26 may require micrometer ($\mu$m) order accuracy in fabrication, making it difficult to obtain a high production yield for the conventional filter element 10.

2) The significantly reduced length of the inductor segments 20, 22, 24, and 26 results in an unintentional strong electromagnetic coupling between respective adjacent capacitor segments 28, 30, and 32, which impacts the desired performance of the filter element 10.

3) The difference in line width between the inductor segments 20, 22, 24, and 26 and the capacitor segments 28, 30, and 32 is significantly large. The line width of one capacitor segment (i.e., 28, 30, or 32 in FIG. 1) may be 10 times that of the one inductor segment (i.e., 20, 22, 24, and 26 in FIG. 1). The large difference in line width causes a large stress at the contact or connection between the inductor segments 20, 22, 24, and 26 and the capacitor segments 28, 30, and 32 as a result of temperature cycling during operation of the conventional filter element 10. The large stress may cause a disconnection between a respective inductor segment and capacitor segment in the strip conductor pattern 14. Thus, the conventional filter element 10 has poor reliability due to this disconnection problem.

4) If a device which generates heat during operation, such as a power amplifier, is mounted on the substrate 12 on which the filter element 10 has been formed, heat from the power amplifier may burn or melt one of the thin inductor segments 20, 22, 24, and 26, causing a disconnection in the strip conductor pattern 14.

Thus, a filter element that is formed with a conventional microstrip line has several significant problems, such as low production yields due to the difference in size in line width of the inductor segments and capacitor segments formed in the conventional microstrip line, and disconnections in the conventional microstrip line due to the stress caused between connections of inductor segments and capacitor segments during temperature cycles of the conventional microstrip line.

The present invention works toward providing an improved filter element that is formed with a microstrip line that has uniform line width to effectively improve the production yield and reliability of the improved filter element. The present invention also works toward providing a fabrication method for producing the improved filter element at high production yield.

SUMMARY OF THE INVENTION

The present invention provides a filter element fabricated by forming a strip conductive pattern on a dielectric substrate that has a surface and a cavity with an aperture disposed on the surface of the dielectric substrate, wherein the strip conductive pattern is formed over the aperture of the cavity.

The present invention also provides a filter element fabricated by forming a strip conductive pattern on a dielectric substrate that has a first portion and a second portion, the first portion having a higher relative dielectric constant than the second portion, wherein the width of the strip conductive pattern is maintained constant and the strip conductive pattern is formed over both the first and second portions of the dielectric substrate.

The present invention provides a method for fabricating a filter element that includes a strip conductive pattern on a dielectric substrate, wherein the method for fabricating the filter element comprises forming a cavity with an aperture disposed on the surface of the dielectric substrate, filling a material in the cavity so as to flatten the surface of the dielectric substrate, forming the strip conductive circuit pattern on the dielectric substrate so that the strip conductive pattern is over the aperture of the cavity, and removing the material from the cavity.

DETAILED DESCRIPTION OF THE PREFERRED EMBODIMENTS

Embodiments of the filter element in accordance with the present invention will be described in detail hereinafter with reference to the attached drawings.

Figure 3:
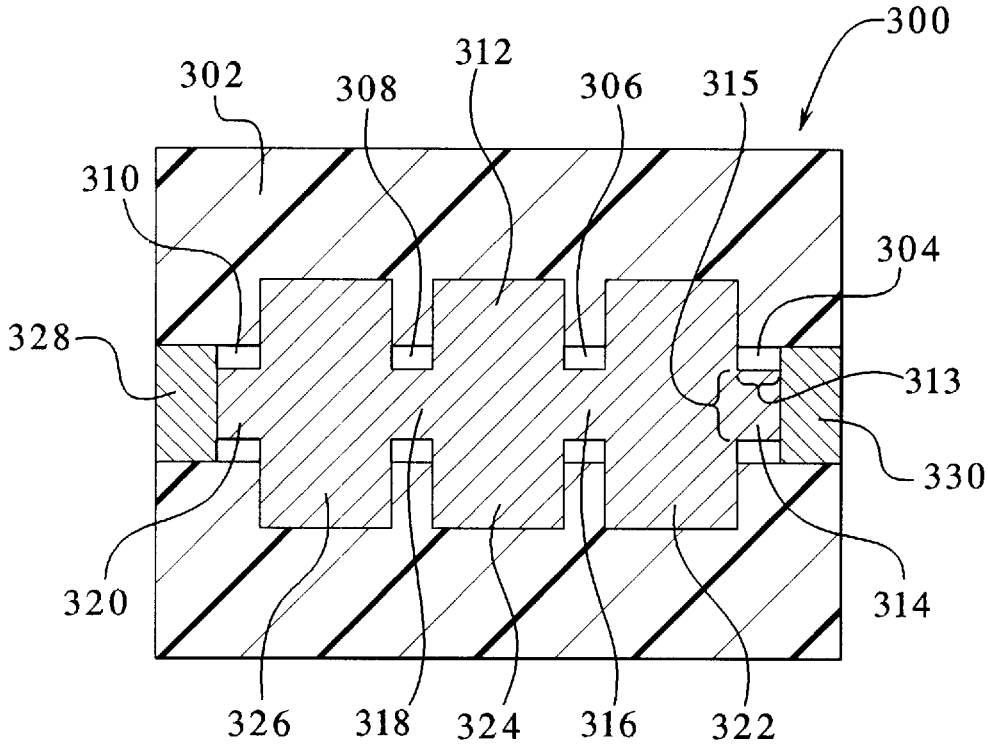
FIG. 3 is a plan view illustrating an exemplary structure of a filter element in accordance with one embodiment of the present invention.
Figure 4:
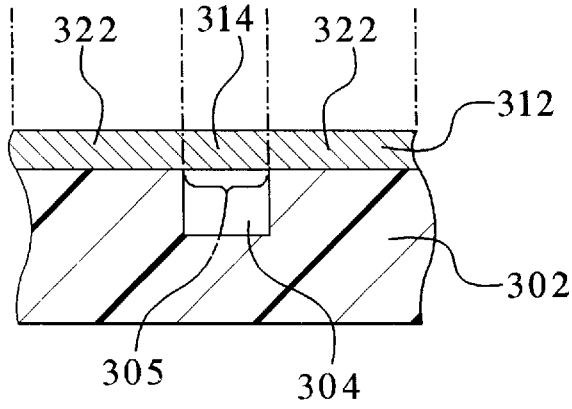
FIG. 4 is a cross sectional view of the filter element in accordance with the embodiment shown in FIG. 3.

First, one aspect of the present invention is described herein with reference to FIGS. 3 and 4. FIG. 3 is a plan view illustrating the structure of a filter element 300 in accordance with one embodiment of the present invention, and FIG. 4 is a cross sectional view of the filter element 300.

In the present invention as shown in FIG. 3 and FIG. 4, the filter element 300 includes a dielectric substrate 302, which may be a printed substrate or a ceramic substrate. The dielectric substrate 302 has a cavity 304 with an aperture 305 as shown in FIG. 4. The cavity 304 may be one of a group of cavities 304, 306, 308, and 310 that are formed in the dielectric substrate 302. The filter element 300 also includes a strip conductive pattern 312. The strip conductive pattern may comprise a Copper (Cu) layer having a print pattern that matches the strip conductive pattern 312. The strip conductive pattern may also comprise a Nickel/Gold (Ni/Au) plating formed on the Copper (Cu) for protecting the Copper against oxidation or for an interconnection to another circuit on a different layer (not shown in figures) disposed on the substrate 302. The strip conductive pattern 312 includes at least one inductor segment 314 with a length 313 and a width 315 that define an inductor pattern size. The strip conductive pattern 312 may be formed such that the inductor segment 314 is disposed over the aperture 305 of the cavity 304 in the dielectric substrate 302. By disposing the inductor segment 314 over the aperture 305 of the cavity 304, the pattern size of the inductor segment 322 may be significantly larger than the corresponding pattern size of the conventional inductor segment 20 in FIG. 1 while maintaining the same inductance behavior as the conventional inductor segment 20. Thus, as further explained below, the desired performance of the filter element 300 is not subject to the same parasitic capacitance and passband loss as the conventional filter element 10 shown in FIG. 1. The inductor segment 314 may be one of a group of inductor segments 314, 316, 318, and 320, where each inductor segment is disposed over a respective cavity 304, 306, 308, and 310 in the dielectric substrate 302.

Figure 5:
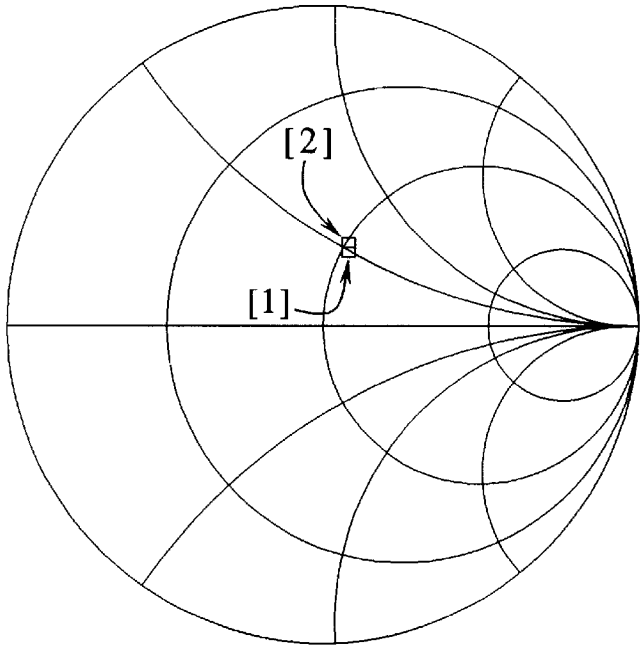
FIG. 5 is a simulation diagram of impedance of the inductance portion of the embodiment shown in FIG. 3 and of the impedance of the inductance portion of the conventional filter element shown in FIG. 1.
Figure 5:
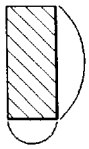
Figure 5:
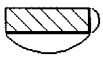

The strip conductive pattern 312 may also include at least one capacitor segment 322, 324, and 326 that is disposed on the dielectric substrate 302 and that is connected to at least one inductor segment 314, 316, 318, and 320 so that the capacitor segments and the inductor segments form a continuous pattern as shown in FIG. 5. The capacitor segments 322, 324, and 326 may be disposed adjacent to but preferably not over a respective cavity 304, 306, 308, and 310 in the dielectric substrate 302. The filter element also includes I/O electrodes 328 and 330 that are connected to the strip conductive pattern 312.

To clarify one aspect of the present convention, the pattern size of the inductor segment 314 that is disposed over cavity 304 in the filter element 300 to obtain the same inductance effect as the inductor segment 20 of the conventional filter element 10 is compared to the pattern size of the inductor segment 20 which is formed on the dielectric substrate 12.

Figure 1:
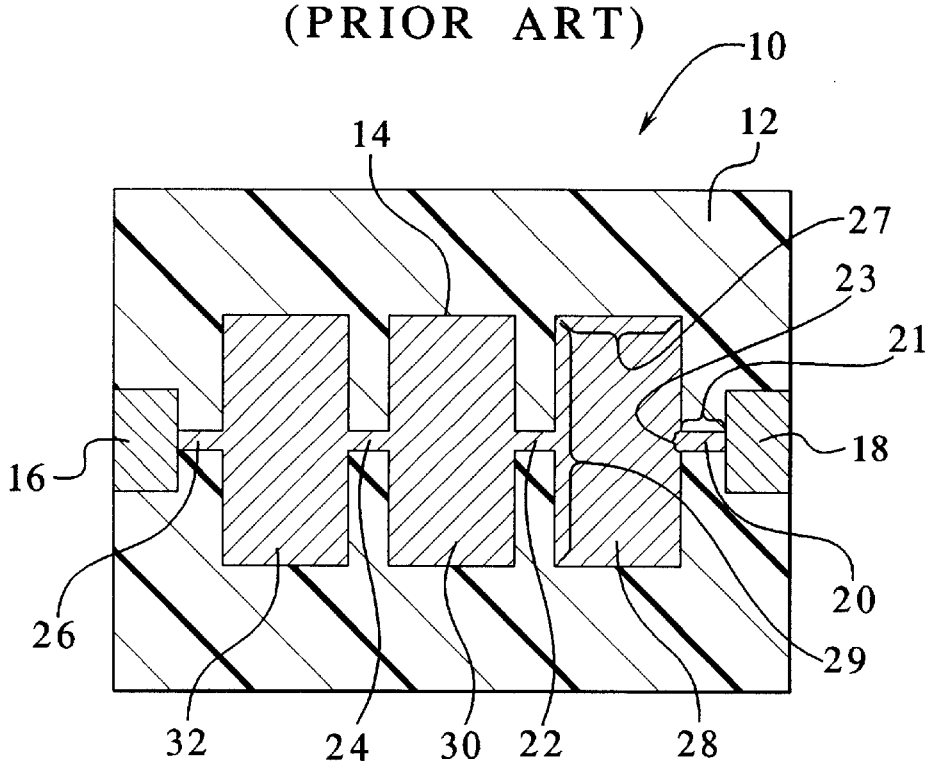
FIG.1 (PRIOR ART)
FIG. 1 is a plan view illustrating a conventional filter element.
Figure 2:
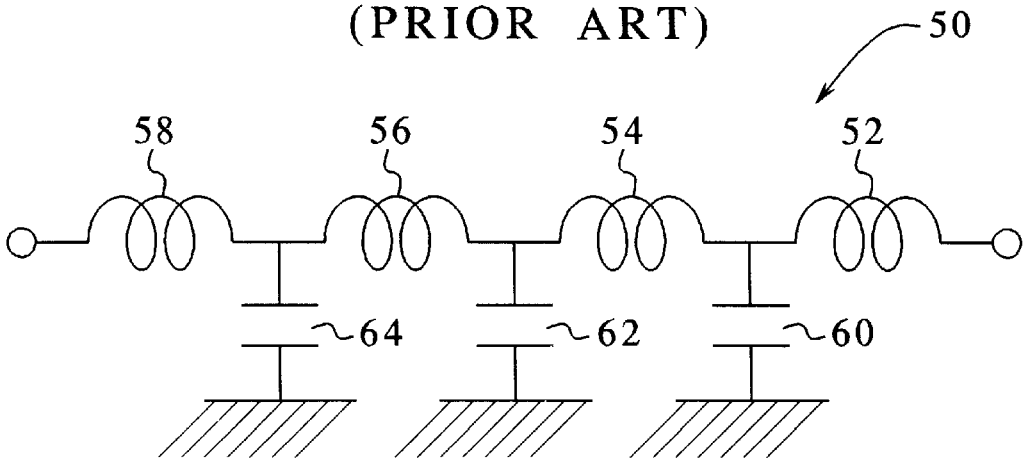
FIG.2 (PRIOR ART)
FIG. 2 is an equivalent circuit of the filter element shown in FIG. 1.

FIG. 5 is a simulation diagram (e.g., a smith chart, which is a polar plot for evaluating the impedance and line loss of a transmission line) obtained by simulating the input impedance (S11) at the 50 ohm (Ω) terminal for the inductor segment 314 in FIG. 5 and for the conventional inductor segment 20 in FIG. 1. As one skilled in the art will appreciate, the simulation diagram represents a polar plot of the complex reflection coefficient (called gamma), or also known as the 1-port scattering parameter s or s11, for reflections from a normalized complex load impedance z=r+jx; the normalized impedance is a complex dimensionless quantity obtained by dividing the actual load impedance (ZL) i n ohms by the characteristic impedance (Zo) (also in ohms, and a real quantity for a lossless line) of the transmission line. The contours of z=r+jx (dimensionless) are plotted on top of this polar reflection coefficient (complex gamma) and form two orthogonal sets of intersecting circles. The center of the simulation diagram in FIG. 5 is at gamma =0 which is where the transmission line is "matched", and where the normalized load impedance z=1+j0; that is, the resistive part of the load impedance equals the transmission line impedance, and the reactive part of the load impedance is zero. The complex variable z=r+jx is related to the complex variable gamma by the formula $$z = r + jx = \frac{1 + gamma}{1 - gamma}$$

As described above, the terminal or load impedance (z) is 50 Ω in the simulation diagram shown in FIG. 5. Thus, if the impedance of either the inductor segment 314 shown in FIG. 3 or the conventional inductor segment 20 shown in FIG. 1 matched the load impedance (z), the plot of the respective gamma would be on the center line of the simulation diagram in FIG. 5. Herein, the relative dielectric constant of the cavity 304 over which the inductor segment 314 is disposed is 1.0. Note that the dielectric constant of air is also known to be 1.0. The relative dielectric constant of the dielectric substrate 12 upon which the inductor segment 20 is formed is 5.7. The thickness of the dielectric substrate 12 upon which the inductor segment 20 is formed is 900 $\mu$m.

The inductive behavior (i.e., the impedance) of the inductor segment 314 of the filter element 300 corresponds to [1], and the inductive behavior (i.e., the impedance) of the inductor segment 20 of the conventional filter element 10 corresponds to [2] as plotted in the simulation diagram in FIG. 5. As shown in FIG. 5, [1] and [2] are plotted approximately at the same point in the simulation diagram. Thus, the inductive behavior of both the inductor segment 314 and the inductor segment 20 are approximately the same. To obtain the inductive behavior that corresponds to [1] as plotted in FIG. 5, the inductor segment 314 has a width 315 of approximately 1.0 mm and has a length 313 of approximately 0.7 mm. To obtain the inductive behavior that corresponds to [2] as plotted in FIG. 5, the inductive segment 20 has a width 29 of 0.1 mm and has a length 27 of 0.3 mm. Thus, to obtain the same inductive behavior, the pattern size of the inductor segment 314 disposed over the aperture 305 of the cavity 304 may be 10 times larger in width than the pattern size of the conventional inductor segment 20 that is formed over the dielectric substrate 12. In addition, to obtain the same inductive behavior, the pattern size of the inductor segment 314 may be 2 times larger in length than the than the pattern size of the conventional inductor segment 20. Thus, by having a larger inductor segment pattern size than the conventional inductor segment 20, the above-mentioned problems (e.g., passband loss, low production yields, and poor reliability due to disconnections) associated with the conventional filter element 10 are significantly mitigated in the filter element 300 of the present invention.

Figure 6:
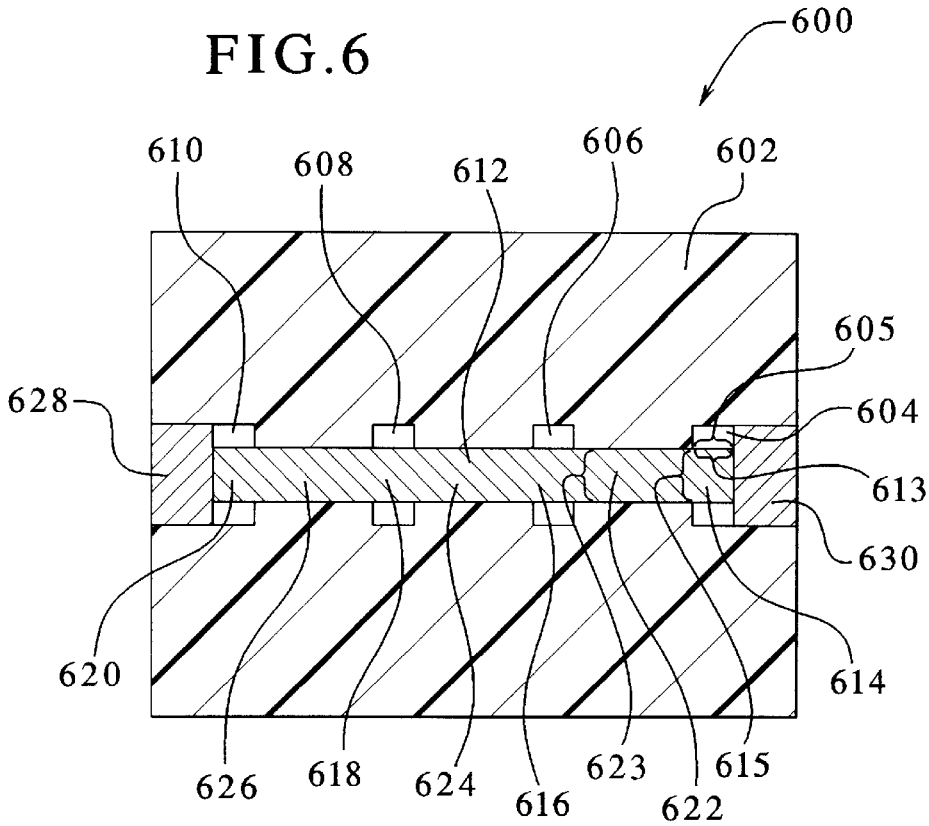
FIG. 6 is a plan view illustrating an exemplary structure of a filter element in accordance with another embodiment of the present invention.

By employing a material used for forming the dielectric portion of the substrate 302 where the capacitor segment 322 is formed as shown in FIG. 3 and FIG. 4 that has a relative dielectric constant of, for example, 50, the line width of the capacitor segment 322 can be narrowed. Therefore, by combining the above-mentioned methods, namely forming the inductor segment 314 over the aperture 305 of the cavity 304 and using a material having high relative dielectric constant to form the dielectric portion of the substrate 302 upon which a narrowed capacitor segment 322 is formed, the filter element 600 in FIG. 6 may be formed. As shown in FIG. 6, the filter element 600 includes a dielectric substrate 602 that has at least one cavity 604 with an aperture 605. However, the cavity 604 may be one of a group of cavities 604, 606, 608, and 610 formed on the dielectric substrate 602. The filter element 600 also includes a strip conductive pattern 612 that has at least one inductor segment 614 with a length 613 and a width 615 that define an inductor pattern size. The strip conductive pattern 612 may be formed such that the inductor segment 614 is disposed over the aperture 605 of the cavity 604 in the dielectric substrate 602. The inductor segment 614 may be one of a group of inductor segments 614, 616, 618, and 620, where each inductor segment is disposed over a respective cavity 604, 606, 608, and 610 in the dielectric substrate 602.

The strip conductive pattern 612 also includes at least one capacitor segment 622 that has a width 623 that is approximately equal to the width 615 of the inductor segment 614. The capacitor segment 622 is disposed over a respective portion of the dielectric substrate 602, where the respective portion comprises the material having the high relative dielectric constant discussed above. As illustrated in FIG. 6, the capacitor segment 622 may be one of a group of capacitor segments 622, 624, and 626. Each capacitor segment 622, 624, and 626 is connected to at least one inductor segment 614, 616, 618, and 620 so that the capacitor segments and the inductor segments form a continuous pattern as shown in FIG. 6. The filter element 600 may also include I/O electrodes 628 and 630 that are connected to the strip conductive pattern 612. In one embodiment, the pattern width of the inductor segments 614, 616, 618, and 620 are the same as the pattern width of the capacitor segments 622, 624, and 626 which facilitates fabrication of the filter element 600 and improves production yield over the conventional filter element 10 in FIG. 1.

Figure 7:
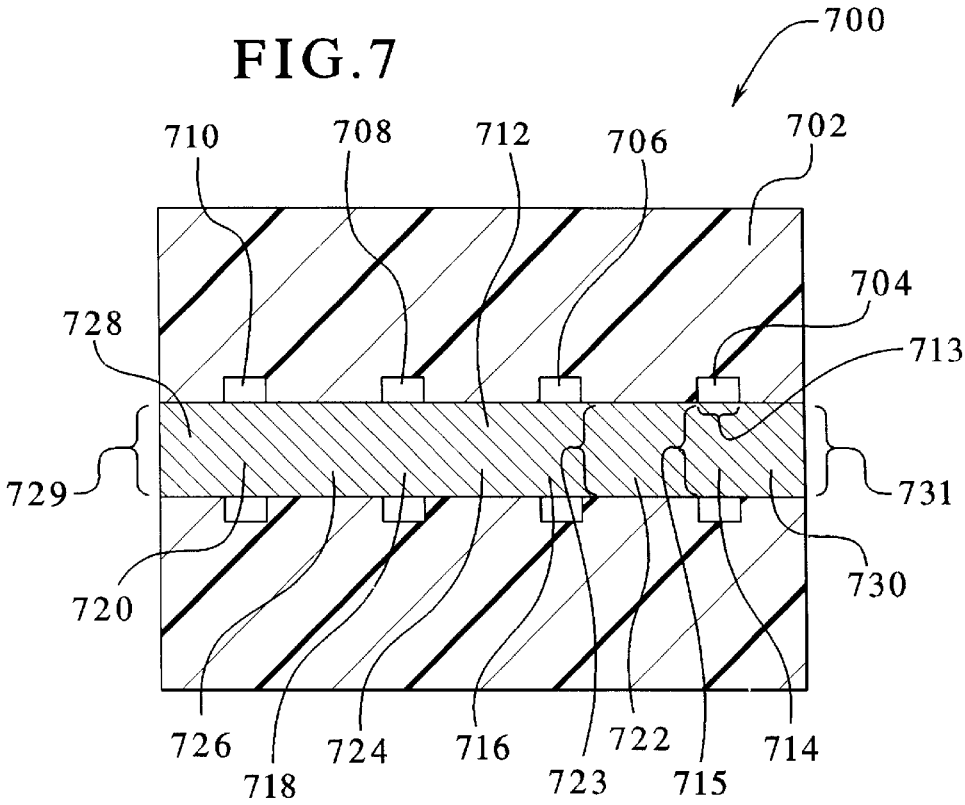
FIG. 7 is a plan view illustrating an exemplary structure of a filter element in accordance with yet another embodiment of the present invention.

Further, in another embodiment shown in FIG. 7, the filter element 700 includes a dielectric substrate 702 formed with cavities 704, 706, 708, and 710. The filter element 700 also includes a strip conductive pattern that has inductor segments 714, 716, 718, and 720 which are disposed over the cavities 704, 706, 708, and 710, respectively. Each inductor segment 714, 716, 718, and 720 has a respective width and length that define an inductor pattern size for each inductor segment. The strip conductor pattern also includes capacitor segments 722, 724, and 726 that are each disposed on a respective portion of the dielectric substrate 702. Each capacitor 722, 724, and 726 has a respective width and length. The filter element further includes I/O electrodes 728 and 730 that each has a respective width 729 and 731. By optimizing the relative dielectric constant of the respective portions of the dielectric substrate 702 upon which the capacitor segments 722, 724, and 726 are disposed and by optimizing the respective pattern size of each inductor segment 714, 716, 718, and 720, the filter element 700 may be formed such that the respective width 729 and 731 of the I/O electrodes 728 and 730, the width (e.g., width 715 of inductor segment 714) of each inductor segment 714, 716, 718, and 720, and the width (e.g., width 723 of capacitor segment 722) of each capacitor segment 722, 724, and 726 are approximately equal.

Figure 8A:
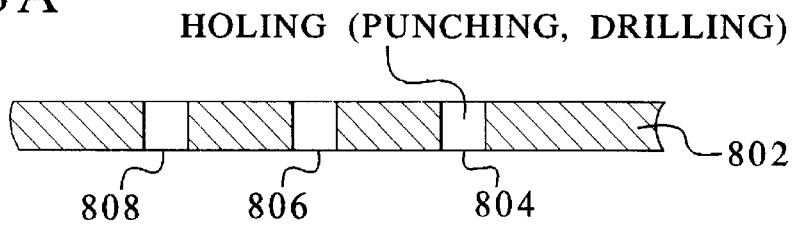
FIGS. 8A to FIG. 8E are diagrams for describing a fabrication process of a filter element of the present invention.
Figure 8B:
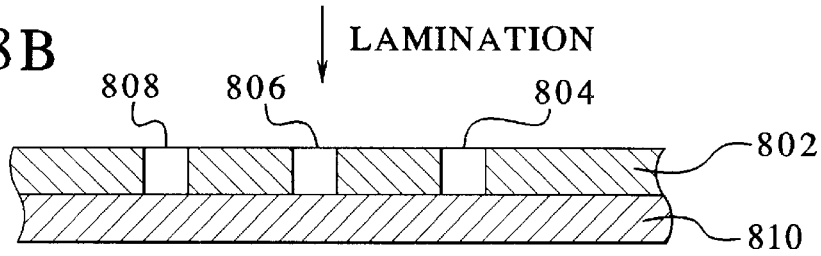
Figure 8C:
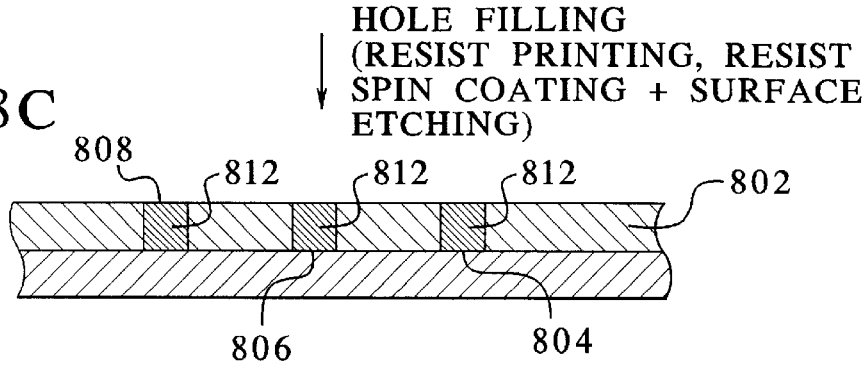
Figure 8D:
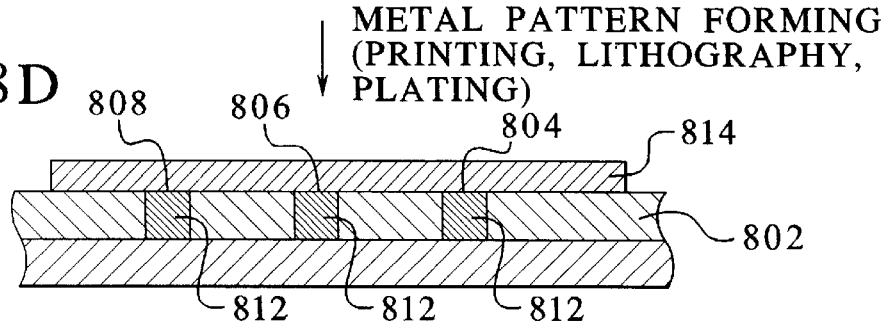
Figure 8E:
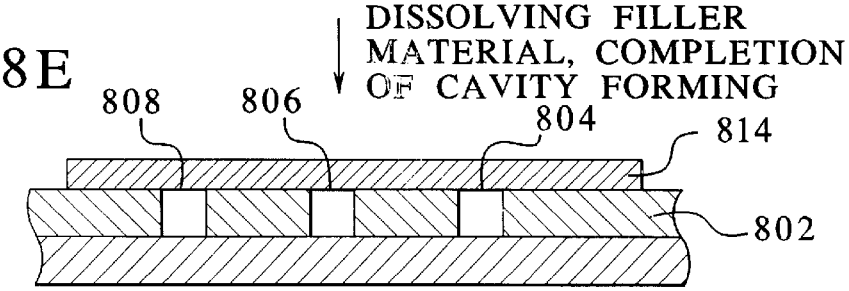

The structure of a filter element may be fabricated in accordance with the present invention by use of an exemplary process depicted in FIGS. 6A through 6E.

a) First, as depicted in FIG. 8A, a first dielectric substrate layer 802 is punched or drilled to form cavities 804, 806, and 808. The first dielectric substrate layer may comprise an epoxy material, a fluoro material, or a ceramic material.

b) Next, as shown in FIG. 8B, the first dielectric substrate layer 802 is laminated on a second dielectric substrate layer 810. The second dielectric substrate layer may comprise an epoxy material, a fluoro material, or a ceramic material.

c) The cavities 804, 806, and 808 of the first dielectric substrate layer 802 are then filled with a photoresist 812 (e.g. a polymer) by printing so that the surface level of the cavities 804, 806, and 808 is approximately equal to the surface level of the first dielectric substrate layer 802 as shown in FIG. 8C. In another implementation, this process step for filling the cavities 804, 806, and 808 with the photoresist 812 may be performed by spin coating the surface of the first dielectric substrate layer 802 and then etching back the photoresist to the surface of the first dielectric substrate layer 802 by dry etching.

d) As shown in FIG. 8D, after the cavities 804, 806, and 808 are filled, a filter strip conductive pattern 814 having inductor segments is formed over the first dielectric substrate layer 802 and over the cavities 804, 806, and 808 filled with photoresist 812. To form the filter element 300 in FIG. 3 in accordance with the present invention, the filter strip conductive pattern 814 is formed such that the inductor segments are over the cavities 804, 806, and 808. The filter strip conductive pattern comprises a metal, such as Cu or Cu and Ni/Au. The filter strip conductive pattern 814 may be formed using known printing or plating fabrication techniques.

e) As illustrated in FIG. 8E, after the filter strip conductive pattern 814 is formed, the photoresist 812 that fills the cavities 804, 806, and 808 is solved out (e.g., dispersed or dissolved from the cavities). In one implementation, the photoresist 812 may be dissolved with an organic solvent, such as acetone. In another implementation, the photoresist may be solved out by oxygen plasma ashing. As the result of performing this process, the structure of the filter element 300 shown in FIG. 3 may be obtained. One skilled in the art will appreciate that the same process may be used to form the other embodiments in accordance with the present invention.

As described above, a cavity (e.g., cavity 304 of filter element 300 in FIG. 3) where inductance is formed in accordance with the present invention is spatial space (e.g., comprises air). The same effect, however, may be obtained by filling the cavity (e.g., cavity 304 of filter element 300) with a material having a low relative dielectric constant.

Figure 9:
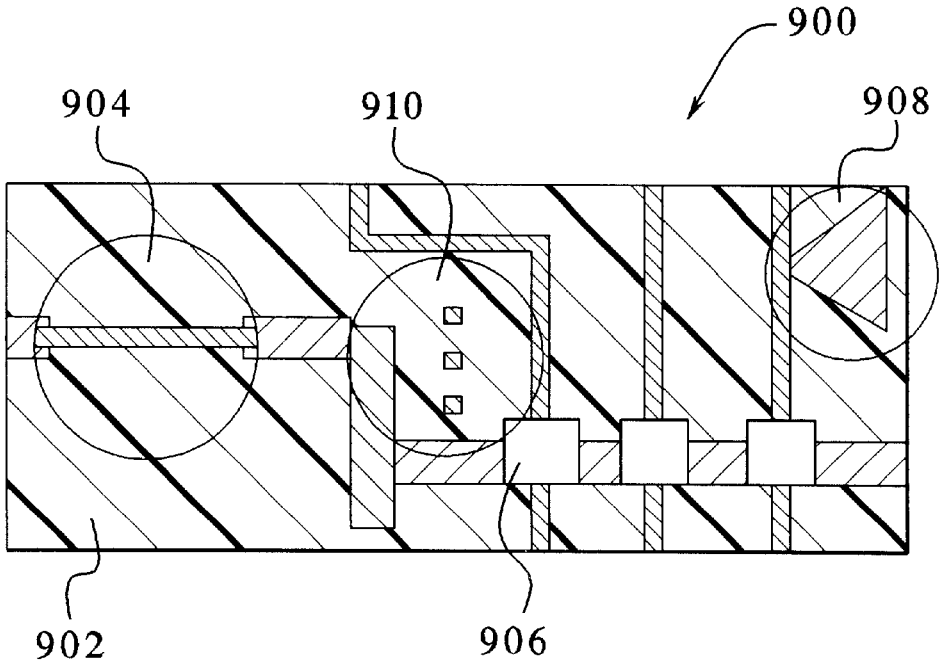
FIG. 9 is a plan view illustrating an exemplary circuit structure in accordance with another embodiment of the present invention.

In another embodiment of the present invention depicted in FIG. 9, a circuit structure 900, such as an integrated circuit (IC), comprises a dielectric substrate 902 upon which a filter element 904 is formed in accordance with the present invention (e.g., filter element 904 as depicted in FIG. 9 may correspond to filter element 600 in FIG. 6). The circuit structure 900 also includes an active element 906, a high frequency removing pattern 910, and an impedance matching pattern 908, which are all electrically connected to the filter element 904 as shown in FIG. 9.

According to the present invention described above, the present invention provides the following advantages over the conventional filter element shown in FIG. 1:

1) the risk of disconnection between an inductor segment and an adjoining capacitor segment in a strip conductive pattern of a conventional filter element may be reduced by equalizing the line width of the inductor segment and the adjoining capacitor in the filter element formed in accordance with the present invention, 2) the occurrence of unintentional electromagnetic coupling between adjacent capacitor segments in a strip conductive pattern due to an inductor segment between the adjacent capacitor segments having a short length is reduced as a inductor segment of a filter element formed in accordance with the present invention may have a larger line length, 3) the deterioration of production yield due to variation t the line width in the strip conductive patter of the conventional filter element is reduced as a larger line width can be applied in a strip conductive pattern of a filter element formed in accordance with the present invention, 4) the risk of burn disconnection in the strip conductive pattern of the conventional filter element is reduced as the filter element formed in accordance with the present invention is formed with a strip conductive pattern that has inductor segments with larger pattern sizes than in the conventional filter elements. This reduction in the risk of burn disconnection is provided by the present invention even though a power amplifier or the like may be mounted on the same substrate as the filter element of the present invention and significant heat generation may cause the temperature of the filter element to rise, 5) the line width of strip conductive pattern of the filter element can be equalized to the line width of input/output electrode wiring pattern (usually 50 Ω width) by optimizing the width and the length of the inductor segments and the capacitor segments in the strip conductive pattern, and 6) the structure of the filter element of the present invention can be easily formed using conventional techniques by performing a process modified from the conventional fabrication process.

As described hereinbefore, the present invention works toward providing a filter element fabricated by forming a strip conductive pattern on a dielectric substrate that has a cavity with an aperture on the surface of the dielectric substrate, wherein the strip conductive pattern is formed partially over the aperture of the cavity. As the result, the relative dielectric constant of the portion of the dielectric substrate where the cavity is formed is reduced, the strip line width of the strip conductive pattern where inductance is formed can be approximately equalized to the strip line width of the strip conductive pattern where capacitance is formed. Thus, the production yield and reliability of the filter element may be improved.

According to the present invention, the cavity formed on the dielectric substrate may be filled with a material having a relative dielectric constant different from that of the dielectric substrate. As the result, the portion of the strip conductive line formed over the cavity is reinforced, and the reliability of the filter element may be further improved.

In addition, the present invention works toward providing a filter element fabricated by forming a strip conductive pattern on a dielectric substrate that has a first portion that has a higher relative dielectric constant than a second portion of the dielectric substrate, wherein the width of the strip conductive pattern is maintained constant and the strip conductive pattern is formed over both the first and second portions of the dielectric substrate. As the result, the strip conductive pattern of the filter element is formed easily, and the production yield and reliability of the filter element may be improved.

The present invention also provides a method for fabricating a filter element that includes a strip conductive pattern formed on a dielectric substrate, wherein the method for fabricating the filter element comprises forming a cavity with an aperture on the surface of the dielectric substrate, filling the cavity with a material so as to flatten the surface of the dielectric substrate, forming the strip conductive pattern on the dielectric substrate so that the strip conductive paten is over the aperture of the cavity, and removing the material from the cavity.

As the result, a width of a first portion of the strip conductive pattern where inductance is formed can be approximately equalized to a width of a second portion of the strip conductive pattern where capacitance is formed. Thus, the production yield and reliability of the filter element may be improved.

According to the present invention, the material that is used to fill the cavity may be a polymer material. The material may be solved out and removed by use of organic solvent, which may dissolve the polymer material in the removing step.

As the result, the cavity spaces are formed more easily, the filter element having a uniform strip line width is fabricated easily at high production yield.

What is claimed is:

1. A filter element comprising:

a dielectric substrate having a surface and a cavity with an aperture; and a strip conductive pattern having a first segment and a second segment, the first and second segments are disposed in series between ends of the strip conductive pattern, the strip conductive pattern is disposed on the dielectric substrate so that the first segment is over the aperture of the cavity and the second segment is over the surface of the dielectric substrate, wherein the first segment has a predetermined inductance effect and the second segment has a predetermined capacitive effect on a signal that is transmitted via the strip conductive pattern, the first segment is smaller than the second segment, and the first segment is smaller than the aperture of the cavity.

2. The filter element of claim 1, wherein the cavity contains a material that has a relative dielectric constant that is different from that of the dielectric substrate.

3. The filter element of claim 2, wherein the relative dielectric constant of the material is lower than that of the dielectric substrate.

4. The filter element of claim 1, wherein the first segment has a width and the aperture of the cavity extends beyond the width of the first segment.

5. The filter element of claim 1, wherein the first segment has a pattern size that is larger than if first segment were to be disposed over the surface of the dielectric substrate to have the same predetermined inductance effect.

6. The filter element of claim 1, wherein the first segment has a width that is two (2) times larger than if first segment were to be disposed over the surface of the dielectric substrate to have the same predetermined inductance effect.

7. The filter element of claim 1, wherein the cavity has a relative dielectric constant that is lower than the dielectric substrate.

8. The filter element of claim 7, wherein the first segment is larger than a third segment of the strip conductive pattern that is disposed over the surface of the dielectric and that has an inductance effect that is substantially equivalent to the predetermined inductance effect of the first segment.

9. The filter element of claim 8, wherein the first segment has a width that is two (2) times larger than a width of the third segment.

10. The filter element of claim 8, wherein the first segment has a width that is five (5) times larger than the a width of the third segment.

11. The filter element of claim 8, wherein the first segment has a width that is ten (10) times larger than a width of the third segment.

12. The filter element of claim 8, wherein the first segment has a length that is one and a half (1.5) times larger than a length of the third segment.

13. The filter element of claim 8, wherein the pattern size of the first segment has a length that is two (2) times larger than a length of the third segment.

14. The filter element of claim 7, wherein the relative dielectric constant of the dielectric substrate is approximately 5.7 or greater.

15. The filter element of claim 14, wherein the dielectric substrate has a thickness of approximately 900 $\mu$m or greater.

16. The filter element of claim 1, wherein the cavity has a relative dielectric constant that is lower than the dielectric substrate, and the strip conductive pattern has a width that is constant.

17. The filter element of claim 16, further comprising an electrode that is connected to the strip conductive pattern and that has the same width as the strip conductive pattern.

18. The filter element of claim 1, wherein the first segment has a length that is two (2) times larger than if first segment were to be disposed over the surface of the dielectric substrate to have the same predetermined inductance effect.

19. A filter element comprising:

a dielectric substrate having a plurality of cavities, each cavity having an aperture; and a strip conductive pattern having a plurality of capacitor segments and a plurality of inductor segments, each inductor segment is connected to at least one capacitor segment;

wherein each capacitor segment is disposed on the dielectric substrate and each inductor segment is disposed over the aperture of a respective one of the cavities, and wherein each capacitor segment is larger than each inductor segment.

20. The filter element of claim 19, wherein each inductor segment has a pattern size defining a predetermined inductive effect, the pattern size is larger than if the respective inductor segment were to be disposed on the dielectric substrate.

21. The filter element of claim 19, wherein the strip conductive pattern has a constant width.

22. The filter element of claim 19, wherein the dielectric substrate has a plurality of high dielectric constant portions and a plurality of remaining dielectric portions, each high dielectric portion has a dielectric constant that is higher than the remaining dielectric portions, each capacitor segment is disposed over a respective one of the high dielectric portions of the dielectric substrate, and the strip conductive pattern has a constant width.

23. The filter element of claim 22, further comprising an electrode that is connected to the strip conductive pattern and that has the same width as the strip conductive pattern.

24. The filter element of claim 19, wherein the first segment is smaller in size than the aperture of the cavity.

25. The filter element of claim 19, wherein the first segment has a smaller width than the aperture of the cavity.

* * * * *